US006276561B1

(12) United States Patent
Godoy

(10) Patent No.: US 6,276,561 B1
(45) Date of Patent: Aug. 21, 2001

(54) SCUBA CYLINDER

(76) Inventor: Alejandro Godoy, 4000 Madison Ave., #D, Culver City, CA (US) 90232

( * ) Notice: Subject to any disclaimer, the term of this patent is extended or adjusted under 35 U.S.C. 154(b) by 0 days.

(21) Appl. No.: 09/633,581

(22) Filed: Aug. 7, 2000

(51) Int. Cl.[7] ..... B65D 8/00
(52) U.S. Cl. ..... 220/761; 220/581
(58) Field of Search ..... 220/761, 581, 220/592, 669, 770, 724, DIG. 13

(56) References Cited

U.S. PATENT DOCUMENTS

| | | | | |
|---|---|---|---|---|
| 795,870 | | 8/1905 | Voelkeay . | |
| 4,463,978 | | 8/1984 | Mountain et al. | 294/31.2 |
| 4,556,245 | | 12/1985 | Gruenwald | 294/31.2 |
| 5,564,587 | * | 10/1996 | Falk et al. | 220/581 X |
| 5,613,490 | | 3/1997 | Mayes et al. | 128/205.22 |
| 5,833,197 | | 11/1998 | Peabody | 248/346.01 |
| 5,927,537 | * | 7/1999 | Falk et al. | 220/581 X |
| 6,095,367 | * | 8/2000 | Blair et al. | 220/581 |

* cited by examiner

*Primary Examiner*—Steven Pollard
(74) *Attorney, Agent, or Firm*—Joseph W. Molasky & Associates

(57) ABSTRACT

A scuba cylinder which does not roll. The cylinder is comprised of sloped panels which from a body that is triangular in cross section. The outer surface of the body is circumscribed with longitudinally extending channels which direct the flow of water evenly over its surface. Included on the cylinder body, on adjacent panels, are elongated recesses and cowls which serve as finger-gripping handles. The interior of the cylinder body is buttressed by Y-shaped reinforcement members whose radially extending arms are joined to the inner sidewalls by a weld.

8 Claims, 2 Drawing Sheets

FIG.3
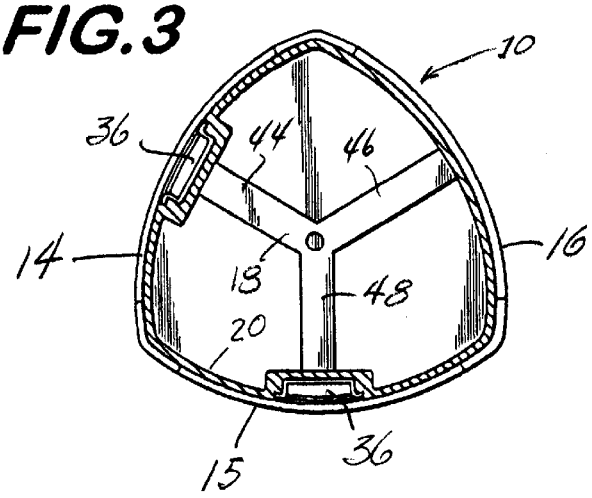
FIG.5
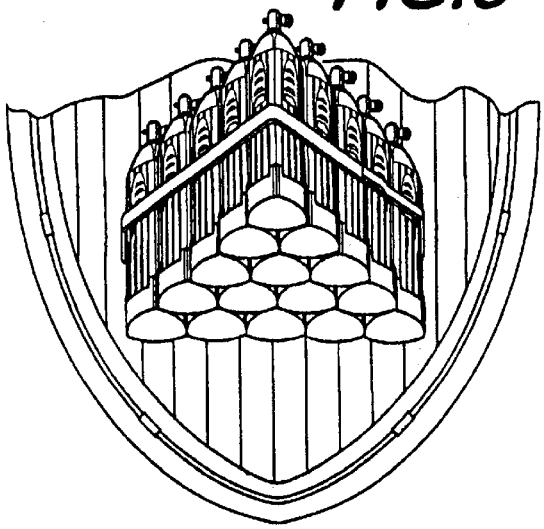
FIG.4
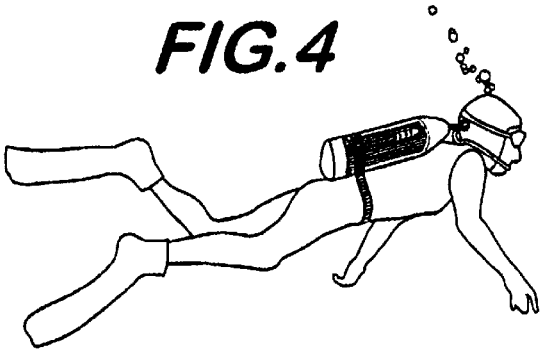
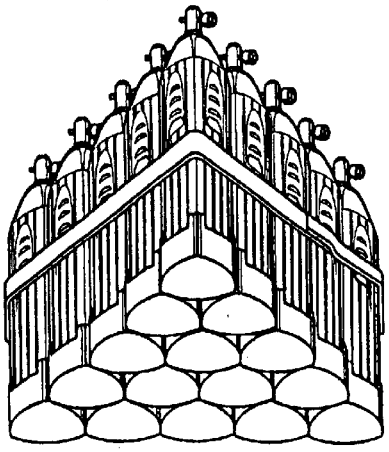
FIG.6
FIG.7
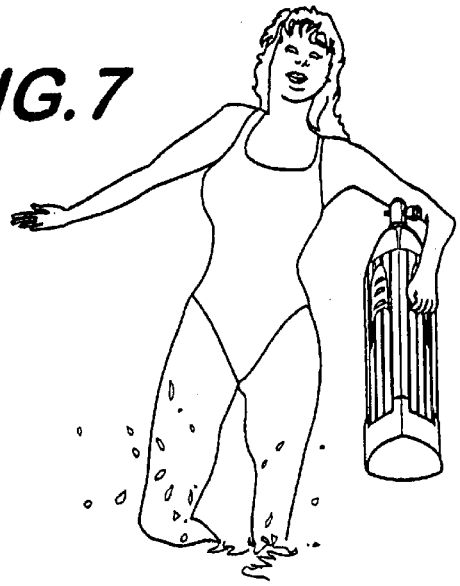

SCUBA CYLINDER

This invention relates to a scuba cylinder which when used in water is uniquely stable, maneuverable and comfortable to wear.

It includes finger-gripping means and when it is not being used, it can be laid on its side without rolling. Also, its unique design makes it suitable for stacking with other like-cylinders in a pyramid-type arrangement.

BACKGROUND OF THE INVENTION

Scuba cylinders are containers for compressed air. They are equipped at the top with a valve for regulating airflow and the choice of a valve will depend on its intended use. For example, when the use is recreational, a K-valve is usually employed; this is similar to an on-off valve in a water faucet.

On the other hand, when the airflow must be regulated to coincide with a specific tank pressure, a J-valve is used.

Still another valve, a DIN, is employed when high pressures are to be encountered.

Accordingly, it is essential for user safety that every scuba cylinder, and its associated parts, be carefully chosen and properly maintained.

Maintenance, however, is a serious problem and the injuries which can be attributed to scuba cylinder use, are due in large part to the manner in which diving tanks are made.

As a rule, scuba cylinders are made of aluminum and steel. A steel cylinder is stronger and it can hold more air per cubic foot than an aluminum cylinder; however, steel has serious disadvantages. For one, it is heavier. Also, steel rusts, and although the exterior can be galvanized to prevent corrosion, the interior cannot because the zinc used in the galvanizing process adversely affects air purity.

Also, it is not possible to obtain cylinders which are flat on the bottom. Present manufacturing methods produce only cylinders which are round at the base and, as a result, they cannot be made to stand upright unless they are fitted with a boot.

A 'boot' is a cover made of rubber or plastic which is placed onto the bottom of a scuba cylinder. Some are made flat on their sides to prevent the tank from rolling when stacked.

Another difficulty with present-day scuba tanks is their cylindrical shape, a feature which makes it impossible to leave them unattended or put them in a stack. As a result, it is not uncommon to see scuba tanks roll and hit against one another.

Because of this 'rolling' tendency, scuba cylinders are sometimes placed in a fabric or plastic sleeve so as to cushion the blow when one tank hits against another; however, the use of such sleeves has not prevented the tanks from becoming severely damaged.

Aluminum tanks provide improvement over steel because they are lighter. Also, they do not rust; instead, the aluminum oxidizes (i.e., anodizes) and forms a film which protects against corrosion.

These advantages, however, are more than offset by the fact that aluminum is a relatively soft metal whose malleable properties make it susceptible to denting and gouging.

Also, aluminum cylinders have an exterior surface which (like steel), is smooth and featureless. This makes them difficult to grasp and carry. Accordingly, when they are moved from one location to another, the tendency is to hoist and carry them by the valve stem and this, when repeatedly done, will ultimately cause damage to the valve assembly.

Accordingly, there is a need for a scuba cylinder which can be easily grasped, carried, and safely stored.

One solution to the hoisting and carrying problem is the Scuba Tank-Pack Rack produced by Pelican Products. This Rack holds up to six cylinders, U.S. or foreign made, with or without boots. It is on the order of an oversized wire dish drain and the wire is coated with plastic. Once the scuba tanks are in the rack, it is carried onto a boat where it can be deck-mounted. The difficulty with this rack is that it fails to provide a means for conveniently carrying individual cylinders; nor does it provide a means by which they can be stacked one atop the other.

Another known carrying system is the Scuba Caddy manufactured by Pier Industries, Inc. This is a base plate having a centrally disposed post equipped with neoprene bumpers. In this system, four scuba tanks are placed onto the base plate and held in an upright position against the bumpers by elastic cords.

Unfortunately, this system too does not solve the cylinder-carrying problem nor does it provide means by which scuba tanks can be assembled and safely stacked one atop the other.

Accordingly, there is a need for a scuba cylinder which can be easily lifted and conveniently carried from one location to another without the need for a rack, caddy or other adjunct.

Also, there is a need for a scuba cylinder which can be conveniently stacked and stored with other like-configured cylinders one atop the other.

SUMMARY OF THE INVENTION

It is an object of this invention to provide a scuba cylinder which can be grasped by finger means and carried conveniently from one location to another.

Another object is to provide a scuba cylinder whose exterior configuration is such that it may be stacked in series with other like-configured cylinders one atop the other.

Another object is to provide a scuba cylinder whose streamlined design enhances its underwater mobility and contributes to its stability.

Still another object is to provide a scuba cylinder whose outer surface is equipped with a series of longitudinally extending channels for directing water flow over its surface.

Yet another object is to provide a scuba cylinder whose interior sidewalls are supported by a reinforcement member.

These and other objects are achieved by providing a scuba cylinder which is triangular in cross-section. The exterior surface of the cylinder body is comprised of three longitudinally extending panels, two of which include finger-gripping means. These finger grips are basically recesses in the outer surface of the cylinder and they are covered in part by cowls or panels which may be gripped and used as a handle.

The bottom of the scuba cylinder is fitted with a protective cover to guard against scraping and to prevent damage to the support on which the cylinders are placed. Also, the covers provide a means by which the cylinders can engage one another when they are placed together in a stack.

Also included on the cylinder body are a series of longitudinally extending channels which circumscribe the entire outer surface. These channels decrease friction by directing the flow of water into the channels as it passes over the cylinder surface.

The scuba cylinder is essentially a hollow body whose length is a vertical wall defined by interior and exterior surfaces. Immediately above this hollow body, and connected thereto, is a conical segment, or shoulder, comprised of three panels. Joined to this conical segment is a neck and valve assembly.

The interior of the cylinder body is also equipped with reinforcement members whose radially extending arms are joined to the sidewall surfaces by a weld.

These and other features of the invention, are further illustrated by the drawings.

BRIEF DESCRIPTION OF THE DRAWINGS

FIG. 3 is a sectional end view taken along line 3—3 of FIG. 2.

FIG. 4 is a pictorial showing the scuba cylinder of this invention as used by a diver.

FIG. 5 is a partial perspective view showing an assemblage of the scuba cylinders of this invention arranged in a stack on the deck of a vessel.

FIG. 6 is a perspective view illustrating the scuba cylinders of this invention in a stacked mode and secured by a wrap-around strap.

FIG. 7 is a pictorial which illustrates the manner in which the scuba cylinder of this invention may be grasped and carried.

This invention will now be described with particularity by reference to the preferred embodiments.

DETAILED DESCRIPTION OF THE PREFERRED EMBODIMENTS

Figure 1:
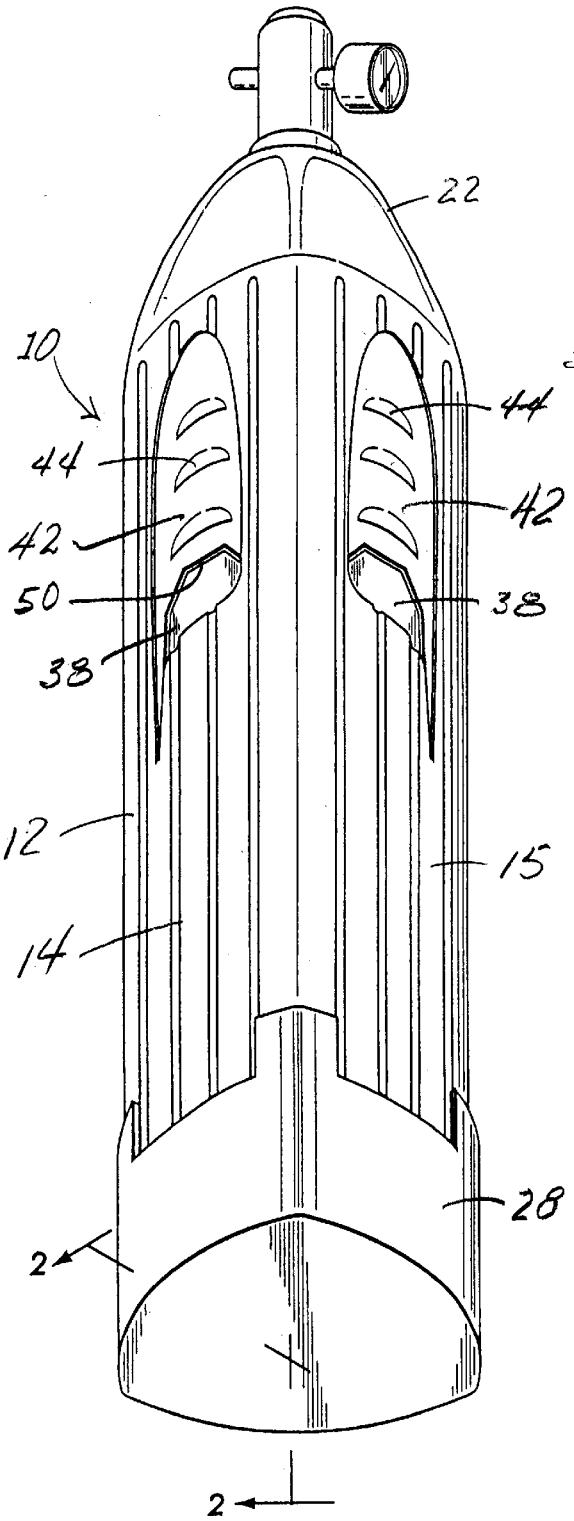
FIG. 1 is a perspective view of the scuba cylinder of this invention.

Shown in FIGS. 1 and 3 is a scuba cylinder 10 (FIG. 1) whose tank body 12 consists of three slightly curved side panels 14, 15 and 16 (FIG. 3).

When viewed in cross section, the tank body 12 is triangular in shape (FIG. 3) and it is hollow except for a reinforcement member 18, which is joined to the inner surface sidewalls 20 by a weld. The construction and assembly of this reinforcement member is discussed in detail hereinbelow.

Figure 2:
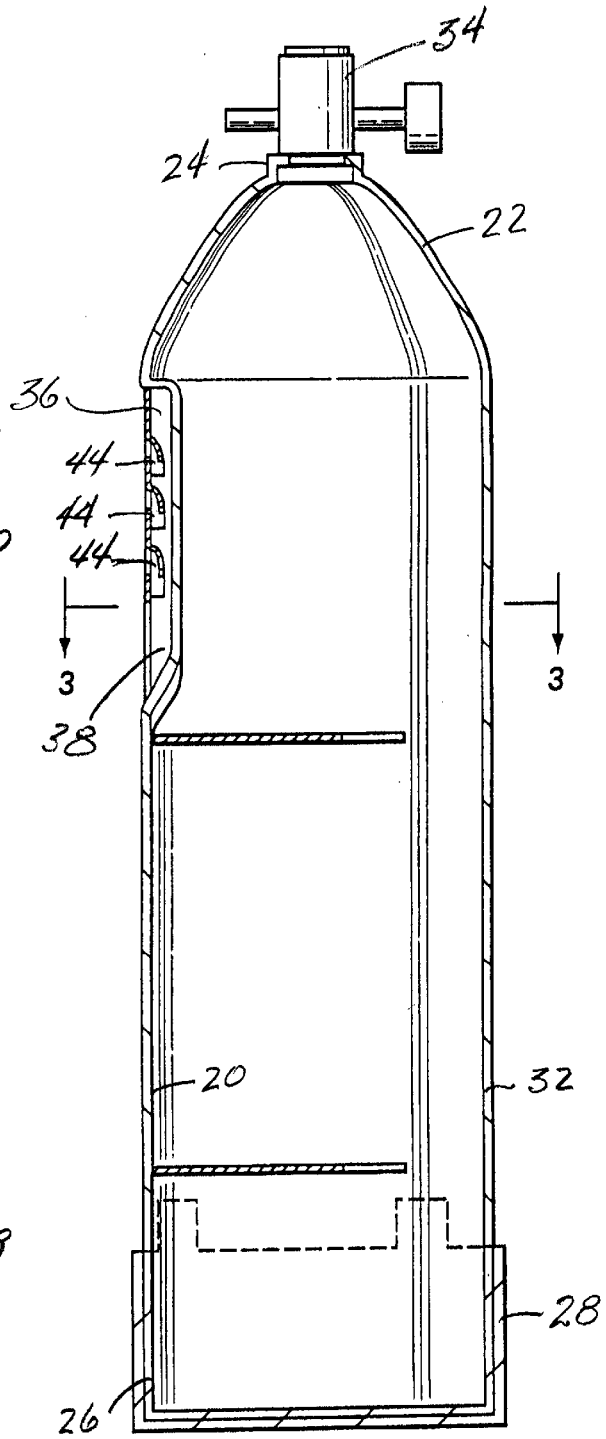
FIG. 2 is a sectional side view taken along line 2—2 of FIG. 1.

Joined to the cylinder body 12 is a shoulder portion 22 and, above the shoulder, a neck 24 to which is secured a valve assembly 34 (FIG. 2). The neck 24 serves as an air transmission passage and the valve 34 provides means by which the air passage is opened and closed so that the flow of air can be controlled.

The bottom portion 26 of the scuba cylinder 10 is protected by a cover or boot 28 which is fitted onto the exterior surface 32 of the cylinder. The bottom of the cylinder 10 is flat and does not require a cover or boot in order to stand upright; however, the boot is a synthetic material such as rubber or plastic and it serves not only to protect the cylinder from dents and gouging but, it also protects the deck or whatever other surface the cylinders are placed upon.

Scuba cylinders are usually made of steel or aluminum with an outer surface that is smooth and polished to reduce friction and enhance water flow. The present invention improves on this feature by inscribing into the exterior surface 32 of the cylinder 10 a series of longitudinally extending recesses or channels which are evenly spaced. These channels circumscribe the cylinder 10 and they direct water flow evenly over its entire surface 32. As a result, the cylinder 10 can be impelled in a desired direction with more control and greater stability than is possible with known cylinders.

The panels which constitute the cylinder body 12 (i.e., FIG. 3, panels 14, 15 and 16) are biased or sloped to prevent rolling. The degree of slope is not critical; however, an angle of from about 3–12° has been found to be most suitable.

This sloped configuration is best illustrated by FIG. 3 which shows in cross section the cylinder's triangular profile and the bias of the side panels 14, 15 and 16. As a result of this configuration, the scuba cylinders can be placed on their sides without rolling and they can be stacked one on top of another without disassembling; however, for safety's sake, once a stack has been assembled, it is advisable to secure the stack with a strap 32 as shown in FIG. 6. When secured in this manner, the stack can be kept intact even on a moving vessel (FIG. 7).

The exterior surface 32 of the scuba cylinder 10 also includes elongated recesses 36 on adjacent side panels 14 and 15 (FIGS. 1, 2 and 3). These extend downwardly to promote water drainage as shown in FIG. 2. Overlying a portion of each recess 36 is a cowl or cover 42 which is abbreviated in length. This abbreviated length leaves exposed a portion of each recess so that a user can place his or her fingers within the drainage area 38 and use the cowl edge 50 as a handle or finger-gripping means. Each cowl 42 also includes vanes 44, the object of which is to direct water from within the recess and into the drainage area 38.

Within the cylinder are reinforcement members 18. These are Y-shaped inserts whose radial arms 44, 46 and 48 (FIG. 3) are secured to the inner sidewalls of the cylinder panels 14, 15 and 16 by a weld. They provide internal support for the cylinder sidewalls and buttress the inner surfaces by maintaining the cylinder panels in a triangular configuration.

The cylinder of this invention is a vast improvement over cylinders of known design. It is ergonomic in the sense that its unique structure makes it more comfortable to wear than conventional round cylinders. Also, its unique design allows a user to put the cylinder down on its side without rolling and it may be stacked and stored in a trunk of a car or on the deck of a boat (FIGS. 5 and 6).

The cylinder of this invention is also an advance in the art because it provides handles in the form of finger-grips which can be used to lift and carry scuba cylinders with a facility which was not heretofore possible.

This invention has been described by reference to precise embodiments; however, it will be appreciated by those skilled in this art that the present invention is subject to modification, and to the extent that any such modification would be obvious to one of ordinary skill, it is considered to be within the scope of the appended claims.

What is claimed is:

1. A scuba cylinder comprised of:

(1) a hollow body whose length is a vertical wall which is triangular in cross section and having interior and exterior surfaces, wherein:

(a) the exterior surface of said hollow body includes recesses which serve as finger-gripping means; and (b) the interior surface of said hollow body is supported by reinforcement members whose configuration is essentially Y-shaped;

(2) a neck; and beneath said neck, (3) a shoulder, said shoulder being comprised of three panels which combine to form an essentially conical segment; and (4) a bottom segment whose outer surface is fitted with a protective cover.

2. The scuba cylinder of claim 1, wherein the outer surface of said hollow body is circumscribed by a series of longitudinally extending channels which direct the flow of water over the cylinder surface.

3. The scuba cylinder of claim 1, wherein the Y-shaped reinforcement member consists essentially of radially extending ribs, the terminal ends of which are joined to the interior surface of said hollow body by a weld.

4. The scuba cylinder of claim 1, wherein the recesses in said hollow body are elongated and covered in part by a cowl which provides a finger-gripping handle means.

5. The scuba cylinder of claim 4, wherein said cowl is equipped with vents which directs water flow into said recesses.

6. The scuba cylinder of claim 1, wherein said protective cover is a synthetic material.

7. The scuba cylinder of claim 6, wherein the synthetic material is plastic or rubber.

8. The scuba cylinder of claim 1 fabricated from steel or aluminum.

* * * * *